US010641027B2

(12) United States Patent
Lee

(10) Patent No.: US 10,641,027 B2
(45) Date of Patent: May 5, 2020

(54) DOOR HINGE

(71) Applicant: SEO WON KOREA CO., LTD., Gimhae-si (KR)

(72) Inventor: Juneyoung Lee, Gimhae-si (KR)

(73) Assignee: SEO WON KOREA CO., LTD., Gimhae-Si (KR)

( * ) Notice: Subject to any disclaimer, the term of this patent is extended or adjusted under 35 U.S.C. 154(b) by 0 days.

(21) Appl. No.: 16/308,179

(22) PCT Filed: Dec. 22, 2016

(86) PCT No.: PCT/KR2016/015079
§ 371 (c)(1),
(2) Date: Dec. 7, 2018

(87) PCT Pub. No.: WO2017/213317
PCT Pub. Date: Dec. 14, 2017

(65) Prior Publication Data

US 2019/0301220 A1 Oct. 3, 2019

(30) Foreign Application Priority Data

Jun. 10, 2016 (KR) ..... 10-2016-0072054

(51) Int. Cl.
*E05F 1/08* (2006.01)
*E05F 5/02* (2006.01)
(Continued)

(52) U.S. Cl.
CPC ..... *E05F 5/02* (2013.01); *E05D 3/02* (2013.01); *E05D 11/00* (2013.01); *E05D 11/06* (2013.01);
(Continued)

(58) Field of Classification Search
CPC ... F16F 15/03; F16F 6/00; F16F 6/005; F24C 15/02; F24C 15/023; E05F 5/02;
(Continued)

(56) References Cited

U.S. PATENT DOCUMENTS 1,700,086 A * 1/1929 Sherwood ..... E05F 5/02 16/85
2,124,349 A * 7/1938 Herbster ..... E05F 1/1075 49/263
(Continued)

FOREIGN PATENT DOCUMENTS

DE 3140039 A1 * 4/1983 ..... E05F 1/1058
EP 0748987 A1 * 12/1996 ..... F24C 15/023
(Continued)

*Primary Examiner* — Chuck Y Mah
(74) *Attorney, Agent, or Firm* — Goldilocks Zone IP Law

(57) ABSTRACT

A door hinge includes a damper attached to a back side of the actuating member, a shaft mounted on the fixing member configured to be movable forward and backward while one end of the shaft is exposed in a direction to the fixing member and moved horizontally backward when contacting with the bumper of the actuating member according to closing of the door, a slide fixed on an upper side of the shaft and moves horizontally backward according to a movement of the shaft, an inclined plane portion provided an upper side of the slide, a platform configured to vertically move up and down on the inclined plane portion of the slide according to the horizontal movement of the slide, and a damper disposed at an upper portion of the platform configured to be pushed up to generate a resistance force to attenuate the closing speed of the door.

2 Claims, 4 Drawing Sheets

(51) Int. Cl.

| | |
|---|---|
| ***E05D 3/02*** | (2006.01) |
| ***E05D 11/00*** | (2006.01) |
| ***E05F 3/20*** | (2006.01) |
| ***E06B 3/36*** | (2006.01) |
| ***E05D 15/02*** | (2006.01) |
| ***E05D 11/06*** | (2006.01) |

(52) U.S. Cl.
CPC ..... *E05D 15/02* (2013.01); *E05F 3/20* (2013.01); *E06B 3/36* (2013.01); *E05Y 2900/30* (2013.01)

(58) Field of Classification Search
CPC ..... E05F 1/1276; E05F 1/1292; E05F 1/1261; E05F 1/1253; E05F 3/20; E05D 3/02; E05D 11/00; E05D 11/06; E05D 11/1064; E06B 3/36; E05Y 2201/41; E05Y 2201/412; E05Y 2201/414; E05Y 2201/416; E05Y 2201/40; E05Y 2201/46; E05Y 2900/30; E05Y 2900/308
See application file for complete search history.

(56) References Cited

U.S. PATENT DOCUMENTS

2007/0283532 A1* 12/2007 Vanini ..... E05F 1/1261 16/277
2008/0289144 A1* 11/2008 Vanini ..... F24C 15/023 16/221
2010/0127606 A1* 5/2010 Collene ..... E05F 1/1292 312/327
2010/0212112 A1* 8/2010 Steurer ..... E05F 1/1261 16/286
2010/0281650 A1* 11/2010 Kleemann ..... E05F 3/20 16/64
2011/0068671 A1* 3/2011 Vanini ..... E05F 5/02 312/405
2012/0260461 A1* 10/2012 Lautenschlager ..... E05D 3/14 16/352
2014/0130302 A1* 5/2014 Bettinzoli ..... E05F 1/1261 16/304
2014/0208542 A1* 7/2014 White ..... E05D 7/12 16/261
2015/0354261 A1* 12/2015 Dora ..... F24C 15/023 49/31
2016/0273777 A1* 9/2016 Kim ..... F24C 15/023

FOREIGN PATENT DOCUMENTS

EP 1764557 A2 * 3/2007 ..... F24C 15/023
EP 2284344 A2 * 2/2011 ..... E05F 1/1261
EP 2562341 A2 * 2/2013 ..... F24C 15/023
EP 2687786 A2 * 1/2014 ..... E05F 5/10
KR 20-0410197 B1 3/2006
KR 20-0428124 B1 10/2006
KR 20-0432780 B1 12/2006
KR 10-2010-0055110 B1 5/2010
KR 10-1480241 B1 1/2015

* cited by examiner

DOOR HINGE

CROSS-REFERENCE TO RELATED APPLICATIONS

This is a continuation of PCT International Application No.: PCT/KR/2016/015079, filed on Dec. 22, 2016, which claims foreign priority to Korean Patent Application No.: 10-2016-0072054, filed on Jun. 10, 2016, in the Korean Intellectual Property Office, both of which are hereby incorporated by reference in their entireties.

TECHNICAL FIELD

The present invention relates to a door hinge, more particularly, improvement of damping apparatus of the door hinge for reducing a noise and an impact, which occur while a closing a door, by precisely attenuating a closing speed of the door without any damage of damping apparatus even if using the same for a long time.

BACKGROUND ART

In general, there are two different types of door hinges, one type is the door can be opened and closed hinged by one side the other type is the door is opened and closed upper and lower side hinged by an upper side, i.e., a side closing type door and a top closing type door.

In the meantime, the latter is used for the door of a gas oven range or a microwave oven for home appliance. It shows in FIG. 1 in which the conventional composition of the door hinge is attached.

As shown in FIG. 1, a conventional door hinge 250 may include a fixing unit 210 installed at the door frame 100, an actuating unit 212 installed at the door 200 and hinge connected by the hinge 226 to the fixing unit 210 and rotatably move around the hinge 226, thereby opening or closing the door.

In the meantime, a guide unit 214 is accommodated between the actuating unit 212 and the fixing unit 210 and guides open and close operation of the door 200.

The guide unit 214 may include a connection plate 216 installed at the fixing unit 210, a rotary motion plate 220 rotatably moving around a pin 218 by connecting to the connection plate 216 by the pin 218, and a guide pin 224 connected to an end of the rotary motion plate 220 and moves up/down along with guide holes 222 which are formed in both sides of the actuating unit 212.

If the guide unit 214 rotate the actuating unit 212, the guide pin 224 vertically move along with the guide hole 222 and simultaneously the rotary motion plate 220 connected to the guide pin 224 rotatably move around the pin 218 according to the movement of the guide pin 224. Therefore, the door 200 steadily performs an opening operation.

In the meantime, the above-described door hinge further may include a spring, the spring may have a function of reducing rotation speed of the door so that the door is closed slowly by generating a compressive force in a door closing start stage.

However, the compressive force of the spring has limited to support a door load with only one spring, there is a disadvantage in that it is impossible to efficiently generate a larger compression force to support the door load when closing of the door is continuously made. Thus the rotational speed of the door cannot be effectively reduced.

It can damage the various electronic parts to shorten the service life of the device, and also cause a lot of inconvenience due to the noise generated if the door is closing with high speed when it enters door closing stage due to this disadvantage.

In the meantime, for example, Korean Patent Publication No. KR10-2010-0055110A, titled "door hinge" is an invention to solve above mentioned drawbacks.

In the above patent publication, a damper is attached to a door hinge to damp the closing speed of the door.

In the KR 10-2010-0055110A, the closing speed of the door is dampened by mounting a damper to the door hinge.

However, the above patent publication, the damper may continuously resist the door frame mounted on the door in a process of directly hitting the damper and attenuates the closing speed of the door.

Thus, such a structure has a problem that unnecessary maintenance is required because the damper cannot withstand the impact but often be broken due to repetitive uses for a certain period of time.

BACKGROUND DOCUMENT

Patent Document

Patent 1: Korean Utility Patent No. 20-0428124, titled "A DOOR HINGE", issued on Sep. 28, 2006.

Patent 2: Korean Patent Publication No. 10-2010-0055110, titled "DOOR HINGE", issued on Jan. 4, 2012.

DETAILED DESCRIPTION OF THE EMBODIMENTS

Technical Problem to be Solved

Therefore, the technical problem as described above is solved according to aspect(s) of the present invention.

An object of the present invention is to provide a hinge door having a damper, which has its structure so that the hinge may reduce an impact and a noise during the door closing without damaging the damper even though repeated use of the door for a long time.

Technical Solution

In order to achieve the above object according to aspect(s) of present embodiment, a door hinge having a fixing member fixedly mounted on the door frame and an actuating member, connected by a connecting member fixedly installed on the fixing member and a hinge shaft, installed on the door, wherein the actuating member rotates about hinge shaft for opening and closing the door, the door hinge including: a bumper attached to a back side of the actuating member; a shaft mounted on the fixing member configured to be movable forward and backward while one end of the shaft is exposed in a direction to the fixing member and moved horizontally backward when contacting with the bumper of the actuating member according to closing of the door; a slide fixed on an upper side of the shaft and moves horizontally backward in accordance with movement of the shaft; an inclined plane portion provided an upper side of the slide; a platform including an inclined bottom portion which is in surface contact with the inclined plane portion of the slide configured to vertically move up and down on the inclined plane portion of the slide according to the horizontal movement of the slide; and a damper disposed at an upper portion of the platform configured to be pushed up to generate a resistance force to attenuate the closing speed of the door while being contacted with the upper portion of the platform by the lifting operation of the platform is provided.

It is the be desirable to configure so that an elongated hole is formed in the central part of the shaft and a guide roller guiding a back movement of the shaft is inserted in the elongated hole.

Effects of the Invention

According to aspect(s) of the present invention, the damper is mounted on the door hinge to improve the structure of the damper so that the closing pressure of the door is not directly transmitted to the damper but is indirectly transmitted to the damper via a shaft, a slide, and a platform. Therefore, it is possible to prevent damage of the damper even though for a long time of use, and furthermore, the operation of door can be performed stably by controlling a closing speed of the door more precisely.

BRIEF EXPLANATION OF SYMBOLS

| | |
|---|---|
| 10: actuating member | 20: fixing member |
| 30: damping apparatus | 40: bumper |
| 50: shaft | 60: slider |
| 70: platform | 72: inclined bottom portion |
| 80: damper | |

BEST MODE

According to aspect(s) of present embodiment, a door hinge having a fixing member fixedly mounted on the door frame and an actuating member, connected by a connecting member fixedly installed on the fixing member and a hinge shaft, installed on the door, wherein the actuating member rotates about hinge shaft for opening and closing the door, the door hinge including: a bumper attached to a back side of the actuating member; a shaft mounted on the fixing member configured to be movable forward and backward while one end of the shaft is exposed in a direction to the fixing member and moved horizontally backward when contacting with the bumper of the actuating member according to closing of the door; a slide fixed on an upper side of the shaft and moves horizontally backward in accordance with movement of the shaft; an inclined plane portion provided an upper side of the slide; a platform including an inclined bottom portion which is in surface contact with the inclined plane portion of the slide configured to vertically move up and down on the inclined plane portion of the slide according to the horizontal movement of the slide; and a damper disposed at an upper portion of the platform configured to be pushed up to generate a resistance force to attenuate the closing speed of the door while being contacted with the upper portion of the platform by the lifting operation of the platform.

DESCRIPTION OF EMBODIMENTS

Hereinafter, the preferred embodiments of the present invention will be described in detail as follows. A representative embodiment of the present invention will be given in the following detailed description for the sake of accomplishing the above specified technical objects of the present invention. The other embodiments available in the present invention are replaced by the description of the present invention.

Figure 1:
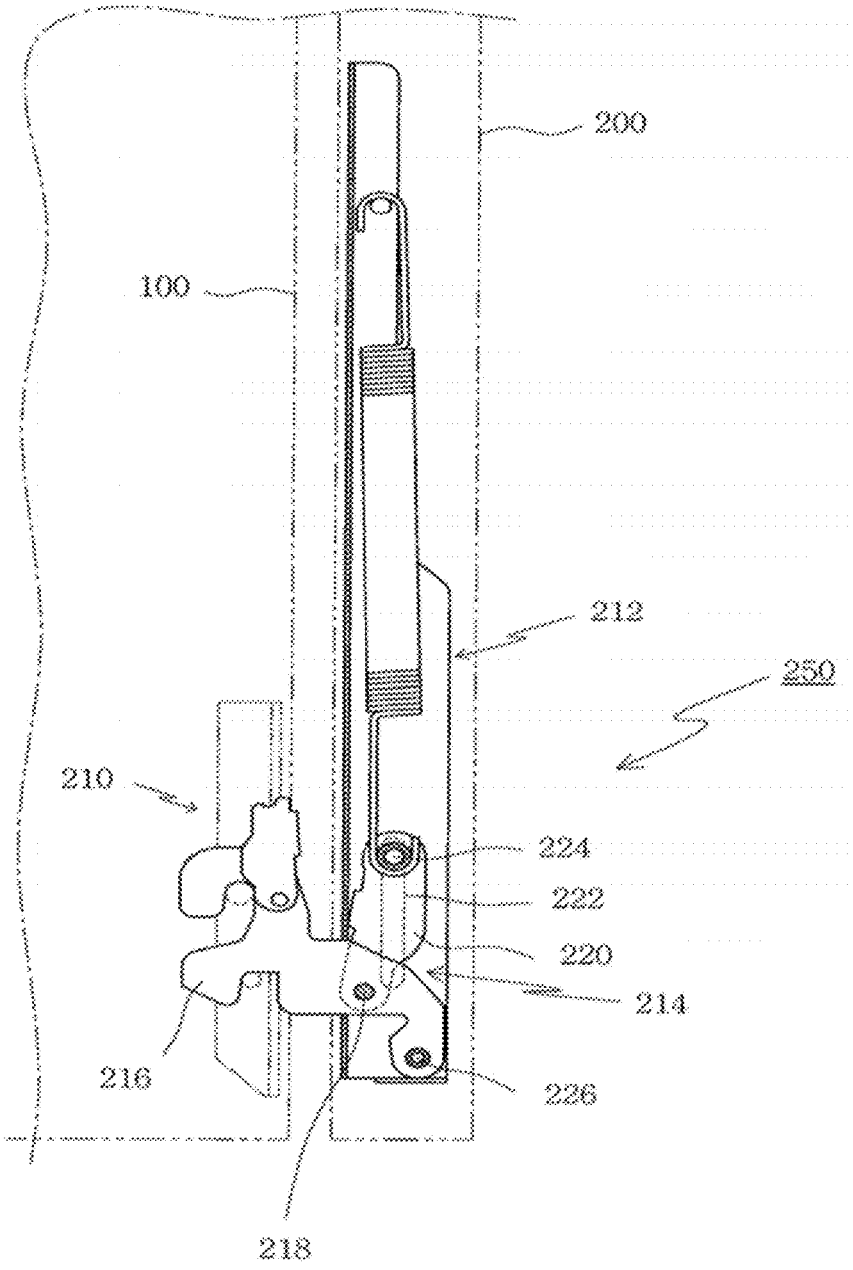
FIG. 1 (Prior Art)
FIG. 1 is a drawing showing the configuration of a conventionally general door hinge.
Figure 2:
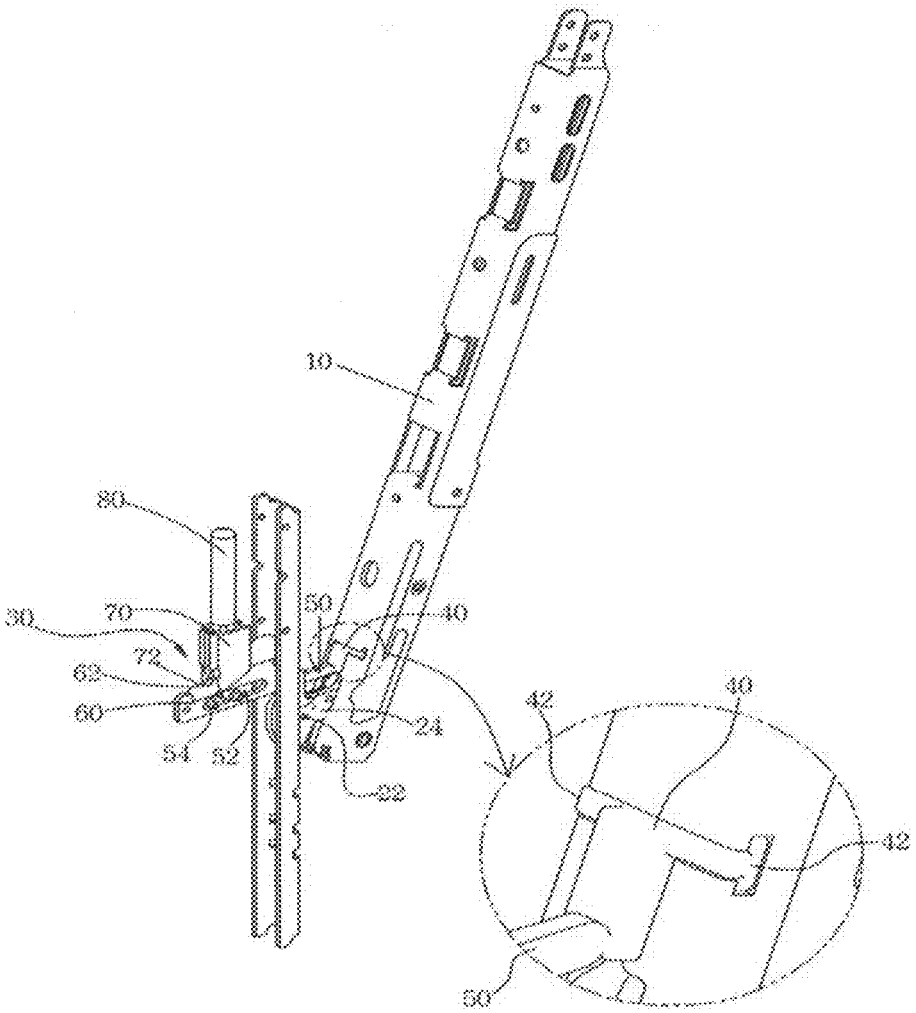
FIG. 2 is a three-dimensional perspective view of a door hinge according to an aspect of present invention.
Figure 3:
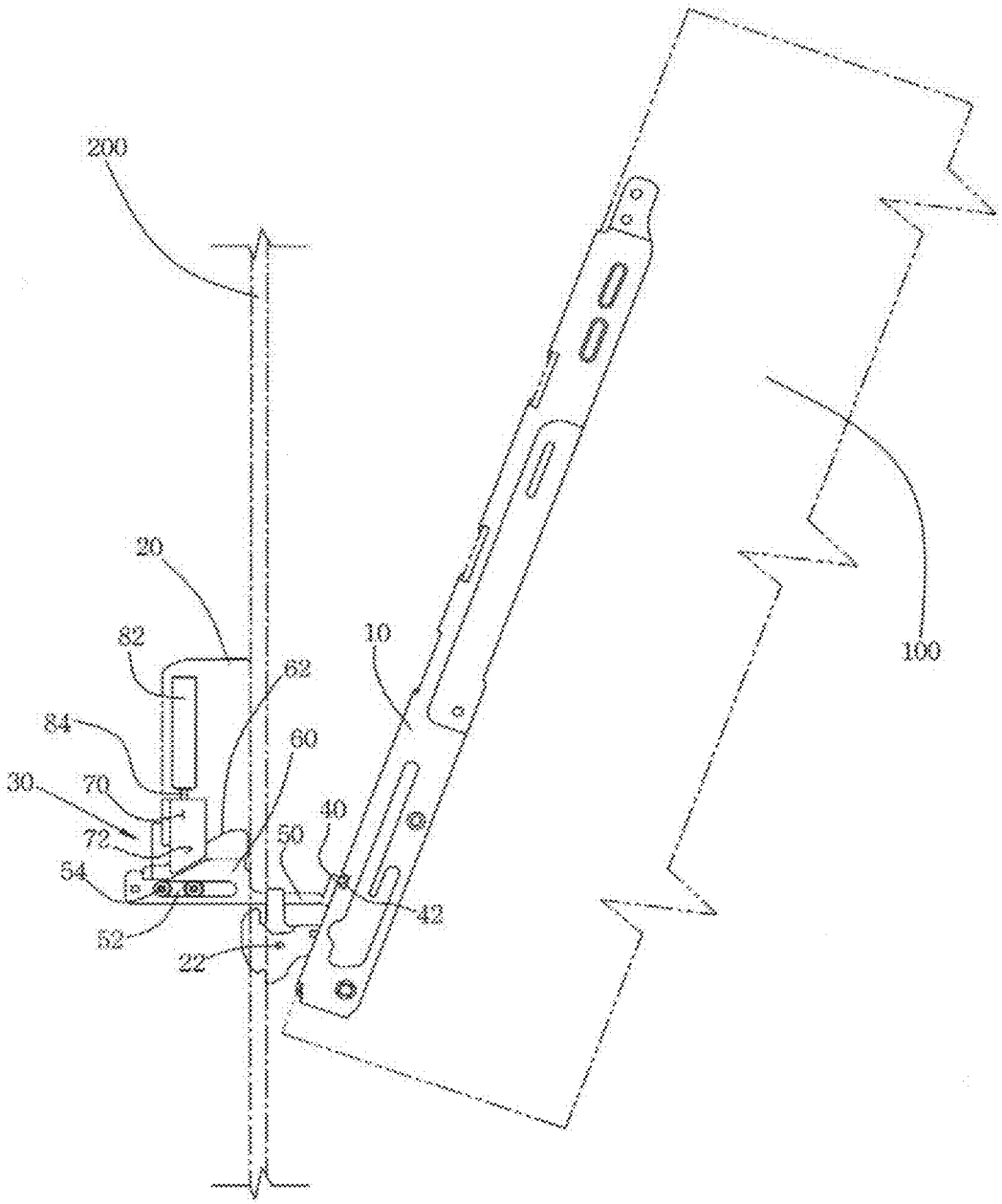
FIG. 3 is a cross section of the door hinge of FIG. 2 according to an aspect of the present invention.
Figure 4:
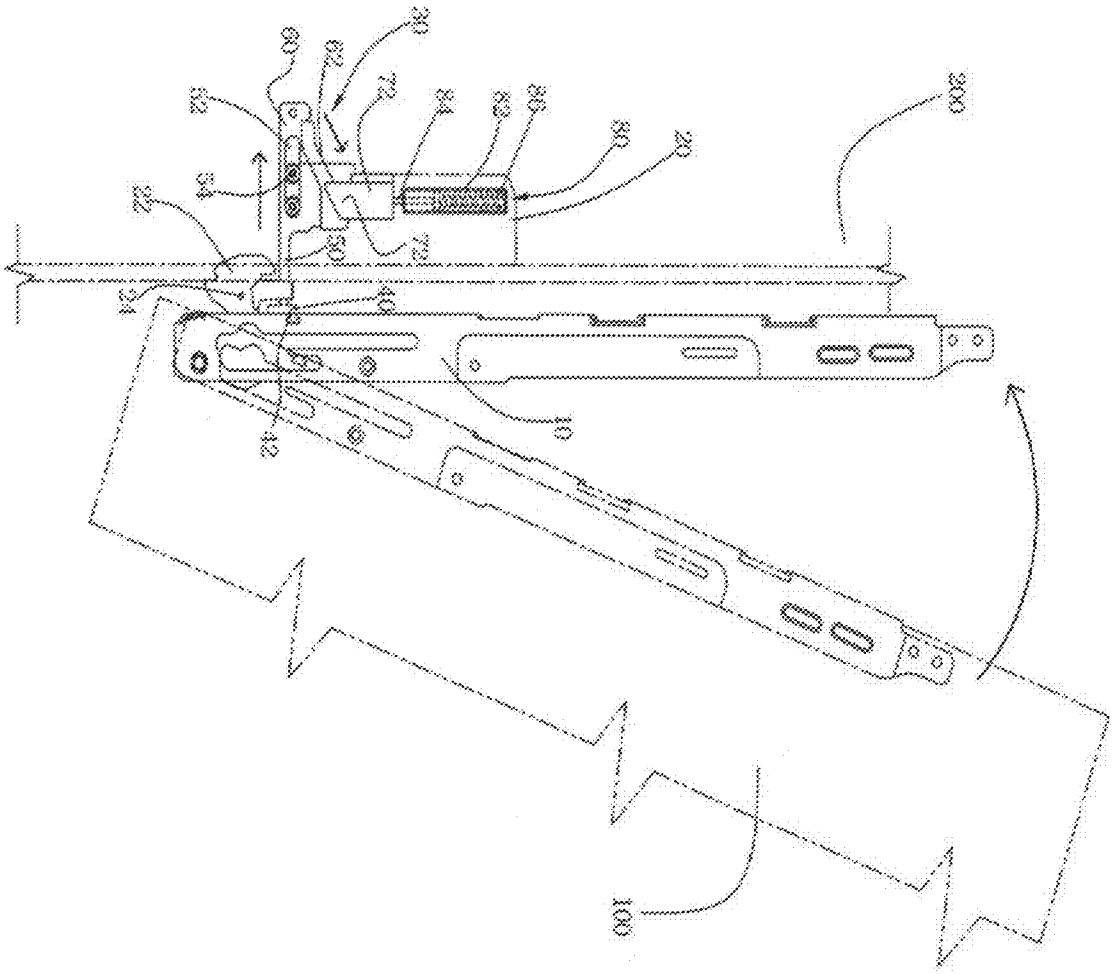
FIG. 4 shows a use state of a damper of the door hinge according to aspect of the present invention.

FIG. 2 is a three-dimensional perspective view of a door hinge according to an aspect of present invention, FIG. 3 is a cross section of the door hinge of FIG. 2 according to an aspect of the present invention, and FIG. 4 shows a use state of a damper of the door hinge according to aspect of the present invention.

As shown in FIGS. 2-4, a door hinge is installed on the home appliance apparatus that may pivotably open and close the door based to the phase, and opening and closing method (in other words, front as to the door hinge of the invention, the door (100) decides on the upper end to the start point.

The door hinge may include a fixing member 20 fixed to a door frame 200 and an actuating member 10 mounted on the door 100, which is connected to the fixing member 20 using a connecting member 22.

The actuating member 10 is mounted on the door 100, connected to the connecting member 22 fixed to the fixing member 20 by the hinge shaft 24 so that the actuating member 10 may open and close the door 100 by way of pivotably rotating about the hinge shaft 24.

A linker (not shown) may be installed in an internal space of the actuating member 10 to open the door 100 stably.

Such the link may include a actuating frame, a rod, and a spring, and the actuating frame, which is installed in the actuating member, slides and pulls the rod to tension the spring while rotating together with the actuating member at the opening and closing action of the door, thereby flexibly supporting the opening operation of the door.

Explanation of such link structure may be omitted because the technology is widely known in the technical field of the door hinge.

In the meantime, the damping apparatus 30 may be installed in the inside of the fixing member 20 to reduce an impact noise by attenuating a closing speed of the door 100 just before closing the door 100. The impact noise may occur when the door is closed with high speed.

The damping apparatus 30 may include a bumper 40, a shaft 50, a slide 60, a platform 70, and a damper 80.

The bumper 40 is fixedly installed at a rear side of the actuating member 10 installed at the door 100 and is directly contacted with the shaft 50 installed at the fixing member 20 to primarily absorb the impact transmitted to the actuating member 10, thereby reducing or preventing a noise.

A pair of stoppers 42 is provided both sides of the bumper 40, wherein the pair of stoppers is combined both sides of the actuating member 10 to fix the bumper 40 to the actuating member 10.

The shaft 50, the slider 60, the platform 70, and the damper 80 are fixedly installed on the fixing member 20 fixed on the door frame 200.

The shaft 50 may include one end of the shaft 50 is partially exposed to a front side of the fixing member 20 and a middle portion of the shaft having an elongated hole 52 with a predetermined length. A guide roller 54 fixed to the fixing member 20 is inserted into the elongated hole of the shaft 50.

The shaft 50 is moved backward together with the slide 60 by the closing pressure of the door 100 while contacting with the damper 40 mounted on the back side of the actuating member 10 according to closing operation of the door 100.

At this time, the guide roller 54 while being inserted in the elongated hole 52 of the shaft 50 may guide a backward movement of the shaft 50.

The slide 60 is installed at the upper end of the shaft 50 and slides to a horizontal direction with the shaft 50 when the shaft moves to the backward with a closing pressure transmitted through the shaft 50 of the door 100.

The inclined bottom portion 72 formed on a lower side of the platform 70 is in surface contact with the inclined plane portion 62 so that the platform 70 can vertically up and down according to the sliding movement of the slide 60.

It is understood that an angle of the inclined plane portion 62 of the slide 60 may be varied according to an aspect of the present invention.

It is also understood that a control of a damper working distance may be easily facilitated through the angle change of inclined plane portion 62.

The platform 70 vertically moves up and down according to the sliding movement of the slide 60 in the horizontal direction and transmits the closing pressure of the door 100 to the damper 80.

The platform 70 may have an inclined bottom portion 72 with a predetermined angle. The platform 70 may transmit a closing pressure of the door 100 to the damper 80 with vertically up and down according to a horizontal direction sliding movement of the slide 60 while the inclined bottom portion 72 in surface contacting with an inclined plane portion 62 formed on the upper side of the slide 60.

A damper 80 is disposed at the upper portion of the platform 70 and generates a resistance force to slow a rotation speed of the door 100 in accordance with the lifting operation of the platform 70.

The damper 80 may include a cylinder 82, a spring installed in the cylinder, and a piston rod 84 which contacts the upper surface of the platform 70 while being exposed to the outside of the cylinder 82, configured to be pushed upwardly according to lifting operation of the platform 70, and generate a resistance force while the spring 86 being compressed.

As described above, the damping apparatus 30 according to aspects of the present invention may not directly transmit the closure pressure of the door 100 to the piston rod 84 of the damper 80 but indirectly transmit to the damper 80 via the shaft 50, the slide 60, and the platform 70. Thus, the damage of the damper 80 can be prevented. In addition, the damper 80 can be used for a long time. Furthermore, the closing speed of the door 100 can be steadily progressed.

Hereinafter, the operation of the damper will be described according to the closing operation of the door according to an aspect of the present invention.

In case of closing the door 100 when it is opened, a user may grasp and push a door handle (not shown), the actuating member 10 mounted on the door 100 is rotating around the hinge shaft 24, thereby closing the door 100.

At this time, the damping apparatus 30 may operate when the door enters between 0° and 20°, just before completing closing the door 100, a closing speed of the door 100 is reduced to alleviate an impact and a noise generated while closing the door 100.

That is, if the closing angle of the door 100 begins to enter between 0°-20°, the bumper 40 of the actuating member 10 mounted on the door 100 may contact the shaft 50 mounted on the fixing member 20, thereby the shaft 50 is moved backward by the closing pressure of the door 100 transmitted to the shaft 50.

Simultaneously, the slide 60 installed at the upper side of the shaft 50 slides in a horizontal direction.

The platform 70 having an inclined bottom portion 72 in surface contact with an inclined side of the slide 60 is vertically moved up and down in accordance with the horizontal movement of the slide 60 and pushes the piston rod 84 of the damper 80 to resist the closing pressure of the door 100, so that the closing operation of the door 100 can be performed gradually.

The closing speed of the door 100 is gradually attenuated after the closing of the door 100 between 0° and 20°, thereby alleviating the shock and noise generated in the closing process.

It would be appreciated by a person skilled in the art that numerous variations and/or modifications may be made to the present disclosure as shown in the specific embodiments. The present embodiments are, therefore, to be considered in all respects to be illustrative and not restrictive.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A door hinge having a fixing member fixedly mounted on the door frame and an actuating member, connected by a connecting member fixedly installed on the fixing member and a hinge shaft, installed on the door, wherein the actuating member rotates about hinge shaft for opening and closing the door, the door hinge comprising:

a bumper attached to a back side of the actuating member;

a shaft mounted on the fixing member configured to be movable forward and backward while one end of the shaft is exposed in a direction to the fixing member and moved horizontally backward when contacting with the bumper of the actuating member according to closing of the door;

a slide fixed on an upper side of the shaft and moves horizontally backward in accordance with movement of the shaft;

an inclined plane portion provided an upper side of the slide;

a platform including an inclined bottom portion which is in surface contact with the inclined plane portion of the slide configured to vertically move up and down on the inclined plane portion of the slide according to the horizontal movement of the slide; and a damper disposed at an upper portion of the platform configured to be pushed up to generate a resistance force to attenuate the closing speed of the door while being contacted with the upper portion of the platform by the lifting operation of the platform.

2. The hinge door of claim 1, wherein the hinge door further comprises an elongated hole formed in a central portion of the shaft and a guide roller inserted in the elongated hole configured to guide a backward movement of the shaft.

* * * * *